US008888614B2

(12) United States Patent
Nutter

(10) Patent No.: US 8,888,614 B2
(45) Date of Patent: Nov. 18, 2014

(54) WARM-UP, EXERCISE AND TRAINING BAT

(71) Applicant: Mark Eugene Nutter, Newark, OH (US)

(72) Inventor: Mark Eugene Nutter, Newark, OH (US)

( * ) Notice: Subject to any disclaimer, the term of this patent is extended or adjusted under 35 U.S.C. 154(b) by 93 days.

(21) Appl. No.: 13/660,995

(22) Filed: Oct. 25, 2012

(65) Prior Publication Data

US 2014/0121042 A1 May 1, 2014

(51) Int. Cl.

| | |
|---|---|
| ***A63B 59/00*** | (2006.01) |
| ***A63B 69/00*** | (2006.01) |
| *A63B 15/00* | (2006.01) |
| *A63B 53/04* | (2006.01) |

(52) U.S. Cl.

CPC ..... *A63B 69/0002* (2013.01); *A63B 2243/0008* (2013.01); *A63B 2069/0004* (2013.01); *A63B 2069/0008* (2013.01); *A63B 69/00* (2013.01); *A63B 69/0015* (2013.01); *A63B 15/005* (2013.01); *A63B 2053/0491* (2013.01)

USPC ..... 473/457; 473/437; 473/422

(58) Field of Classification Search

CPC ..... A63B 69/0002; A63B 2069/0008; A63B 59/06; A63B 59/0066; A63B 2209/08; A63B 2243/005; A63B 2243/004

USPC ..... 473/437, 457, 422, 654, 567, 519, 453

See application file for complete search history.

(56) References Cited

U.S. PATENT DOCUMENTS

| | | | | |
|---|---|---|---|---|
| 514,420 | A * | 2/1894 | Jacobus | 473/564 |
| 1,499,128 | A * | 6/1924 | Shroyer, Jr. | 473/519 |
| 3,578,801 | A * | 5/1971 | Piazza | 473/457 |
| 4,898,386 | A * | 2/1990 | Anderson | 473/457 |
| 5,590,875 | A * | 1/1997 | Young | 473/457 |
| 6,050,908 | A * | 4/2000 | Muhlhausen | 473/457 |
| 6,918,843 | B1 * | 7/2005 | Franssen | 473/457 |
| 7,056,240 | B2 * | 6/2006 | Brock et al. | 473/457 |
| 7,147,580 | B2 * | 12/2006 | Nutter et al. | 473/457 |
| 7,166,046 | B1 * | 1/2007 | Liu | 473/567 |
| 7,727,090 | B2 * | 6/2010 | Gant | 473/457 |
| 8,137,219 | B2 * | 3/2012 | Gant | 473/453 |

* cited by examiner

*Primary Examiner* — Mitra Aryanpour

(57) ABSTRACT

A warm-up and training bat includes a tubular shell with a handle section, a barrel section, and a tapered section connecting the handle section with the barrel section. The handle is attached at an end of the handle section of the bat. An end cap is attached at an end of the barrel section of the bat. A sliding weight mechanism is entirely contained within a pipe disposed within the barrel section of the bat. The sliding weight mechanism can be held in place at an end of the pipe proximate the handle. When a centripetal force is applied during a swing, the sliding weight mechanism moves to a distal end of the pipe. The weight may make a sound or the user may feel the weight shift, helping them perfect their swing.

8 Claims, 2 Drawing Sheets

WARM-UP, EXERCISE AND TRAINING BAT

BACKGROUND OF THE INVENTION

The present invention relates to exercising and training for baseball and softball and, more particularly, to a warm-up, exercise and training bat that incorporates a sliding weight mechanism inside a lightweight plastic tube disposed in a metallic or wooden bat.

When a baseball or softball player attempts to hit a baseball or softball during a game, the player initially takes a standing position at the plate and holds a bat in a rearward cocked position. Once the pitch is thrown, the player swings the bat from the laterally rearward cocked position, through a frontal hitting position, and to a follow-through laterally forward position. The player swings the bat at an appropriate time after the pitcher facing the player has thrown the ball towards the plate where the player is standing. The player begins swinging the bat at the appropriate time. The swing is based on the player making the necessary eye and arm coordination for swinging the bat at the appropriate time in view of the perceived travel of the baseball towards the plate. The batter must take into account the speed of the ball, the type of pitch and the expected flight path to the plate. Ideally, the bat impacts the baseball and causes the ball to travel outwardly from the plate into the game field, or preferably beyond.

Many techniques and devices for improving the batting abilities of baseball and softball players are known to exist, both with a fixed weight and those with a sliding weight. However, none of these techniques and devices includes a bat which provides the weight, balance, and performance of a standard game bat, and does not include external attachments, and does not have an irregular shape.

Therefore, a need exists for a warm-up bat that provides the tactile feel, weight, balance, and performance of a standard game bat, does not have any external attachments, and does not have an irregular shape.

SUMMARY OF THE INVENTION

In one aspect of the present invention, a bat comprises a shell; a pipe fitting inside the shell; a proximate end cap disposed proximate a handle end of the bat and a distal end cap disposed proximate the handle end of the bat, the proximate end cap and the distal end cap disposed on ends of the pipe; and a weight disposed inside the pipe, the weight operable to slide from a first end of the pipe, adjacent the proximate end cap, to a second end of the pipe, adjacent the distal end cap.

In another aspect of the present invention, a warm up and training bat comprises a shell; a pipe fitting inside the shell; a proximate end cap disposed proximate a handle end of the bat and a distal end cap disposed proximate the handle end of the bat, the proximate end cap and the distal end cap disposed on ends of the pipe; a weight disposed inside the pipe, the weight operable to slide from a first end of the pipe, adjacent the proximate end cap, to a second end of the pipe, adjacent the distal end cap; one or more shock pads disposed inside the distal end cap, the one or more shock pads operable to absorb shock of the weight when it moved to the second end of the pipe; and a magnet disposed on the first end of the pipe, the magnet attracting and releasably holding the weight, wherein the magnet is attached to an inside of the proximate end cap.

These and other features, aspects and advantages of the present invention will become better understood with reference to the following drawings, description and claims.

DETAILED DESCRIPTION OF THE INVENTION

Figure 1:
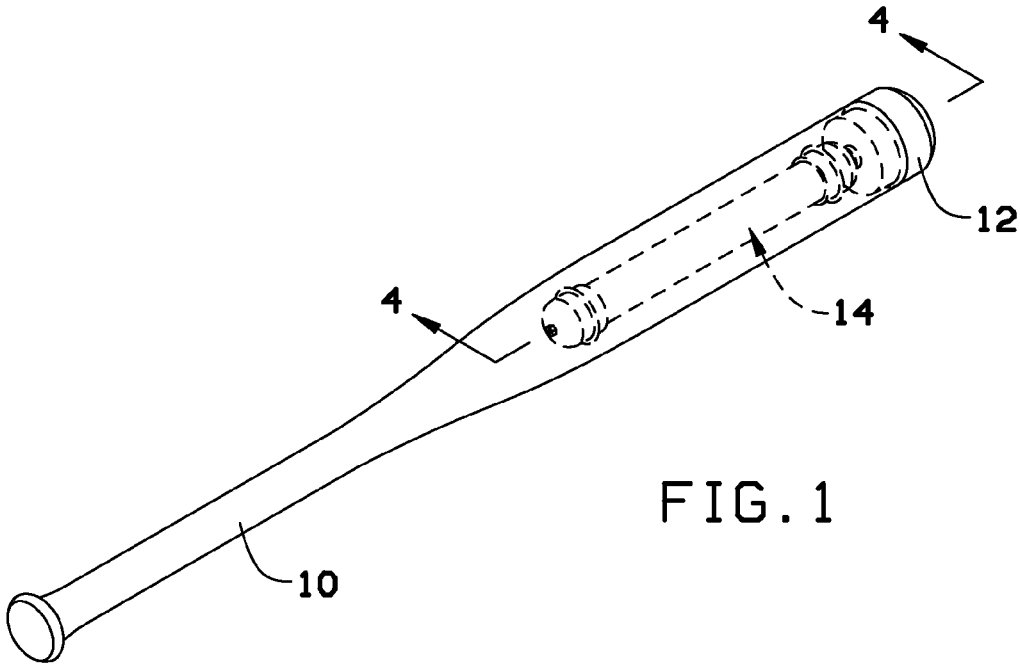
FIG. 1 is a perspective view of a warm-up and training bat according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a warm-up and training bat that includes a tubular shell with a handle section, a barrel section, and a tapered section connecting the handle section with the barrel section. The handle is attached at an end of the handle section of the bat. An end cap is attached at an end of the barrel section of the bat. A sliding weight mechanism is entirely contained within a pipe disposed within the barrel section of the bat. The sliding weight mechanism can be held in place at an end of the pipe proximate the handle. When a centripetal force is applied during a swing, the sliding weight mechanism moves to a distal end of the pipe. The weight may make a sound or the user may feel the weight shift, helping them perfect their swing.

Referring now to FIGS. 1 through 4, a warm-up & training bat (also referred to as a "wut") includes an outer shell 10 (a barrel section, and a tapered section connecting the handle section with the barrel section of the bat). A sliding weight mechanism 14 is positioned inside the outer shell 10 of the barrel section and contained therein by an end cap 12 which is located at the end of the barrel section of the bat (spiral wrap wooden bats utilizing this mechanism may not require end cap 12).

A sliding weight 20 resides and travels inside a pipe 18, such as a PVC pipe, and is naturally positioned closer to the batter's hands while the warm-up and training bat is resting on the batter's shoulder in a near vertical position (handle end down) and just prior to the batter releasing the barrel end of the bat in a downward pivotal outreaching circular motion (bat swing). The sliding weight 20 can be held in the original rest position initially through the use of a magnet 24 and, once the warm-up training bat is released and part way through the batter's swing, the sliding weight 20 can be dislodged from the magnet 24 due to the inherent centripetal force of the batters swing. The sliding weight 20 can travel to the end of the pipe 18, impacting one or more shock pads 34 and providing muscle memory training as a result of the weighted impact. The timely release of the sliding weight 20 allows the batter to swing the warm-up and training bat more naturally (closely resembling a regular bat). Most warm up bats are heavily weighted and do not allow for a normal swing. With the warm-up and training bat combination of the present invention, a proper swing can be identified by way of the sliding weight 20 impacting the end of the bat at the proper point of normal bat-ball contact. A push or pull hit can be practiced and realized while in the on deck circle with this new warm-up and training bat and if the batter drops his shoulder while swinging the warm-up and training bat, the sliding weight will impact the end of the bat prematurely (prior to the front foot hitting zone).

Figure 2:
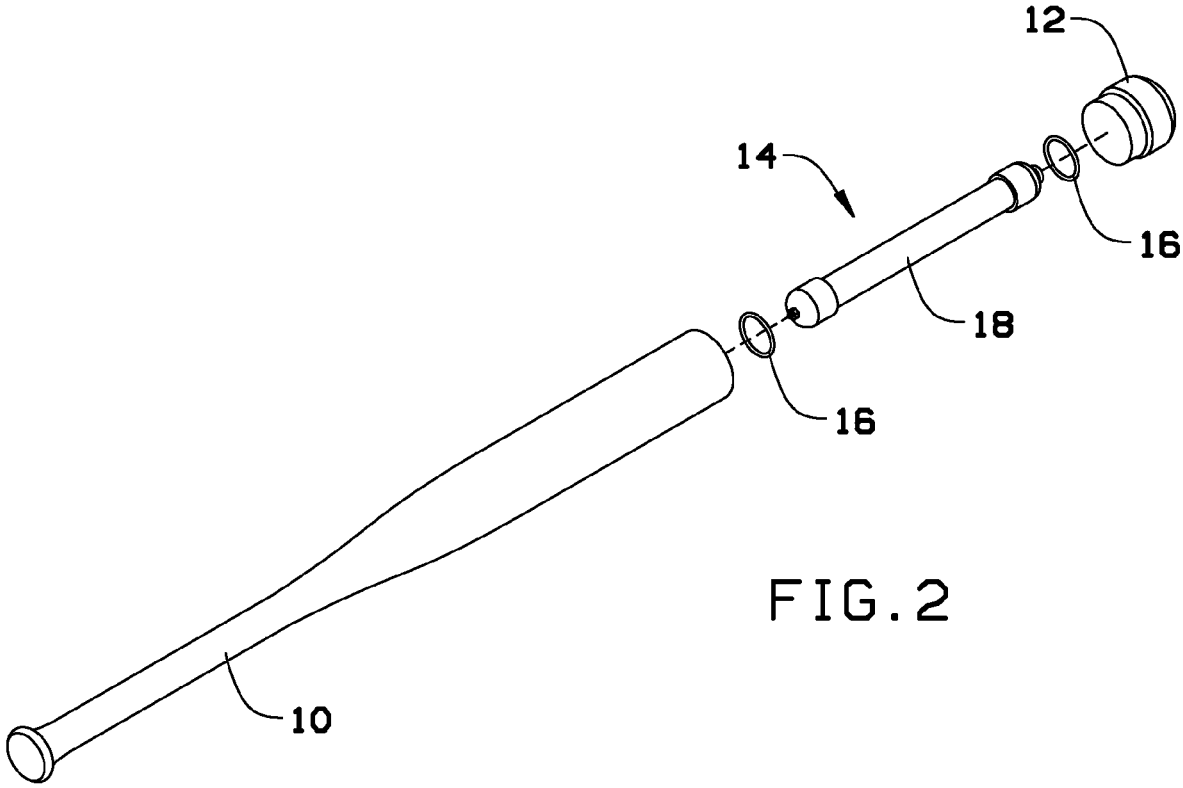
FIG. 2 is an exploded perspective view of the warm-up and training bat of FIG. 1.
Figure 3:
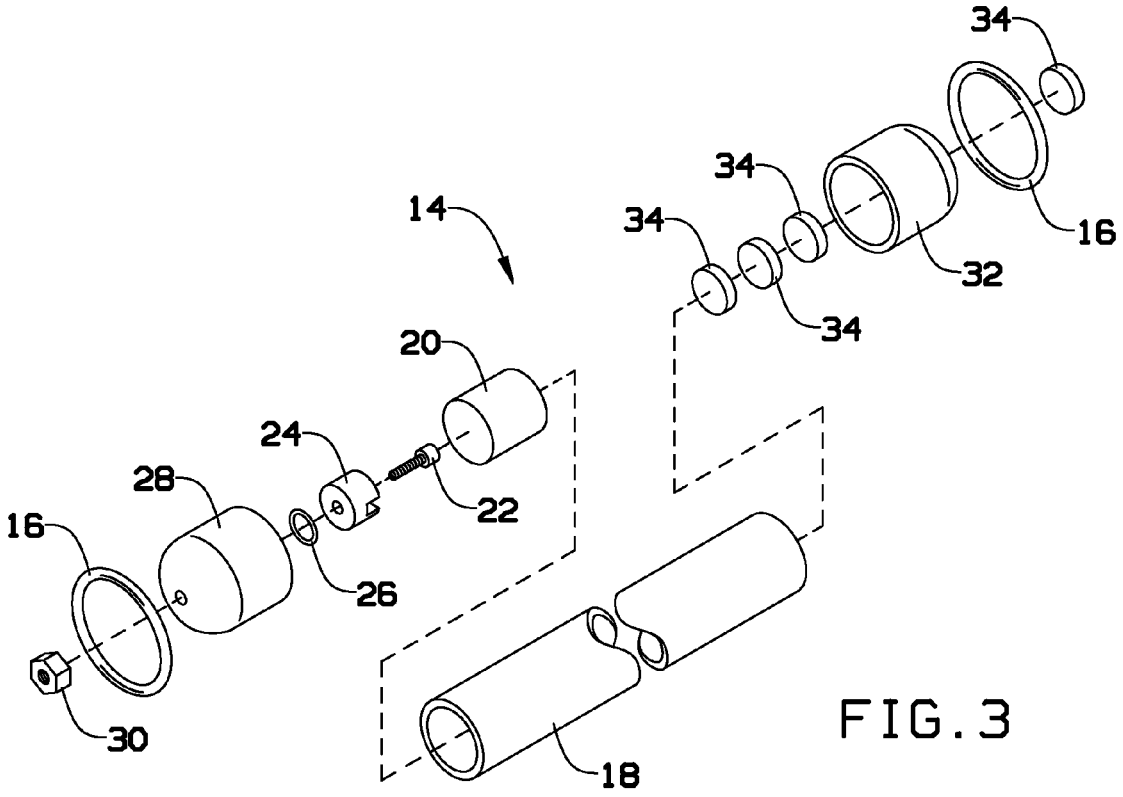
FIG. 3 is an exploded detailed perspective view of a pipe, its mount and its contents of the warm-up and training bat of FIG. 1.
Figure 4:
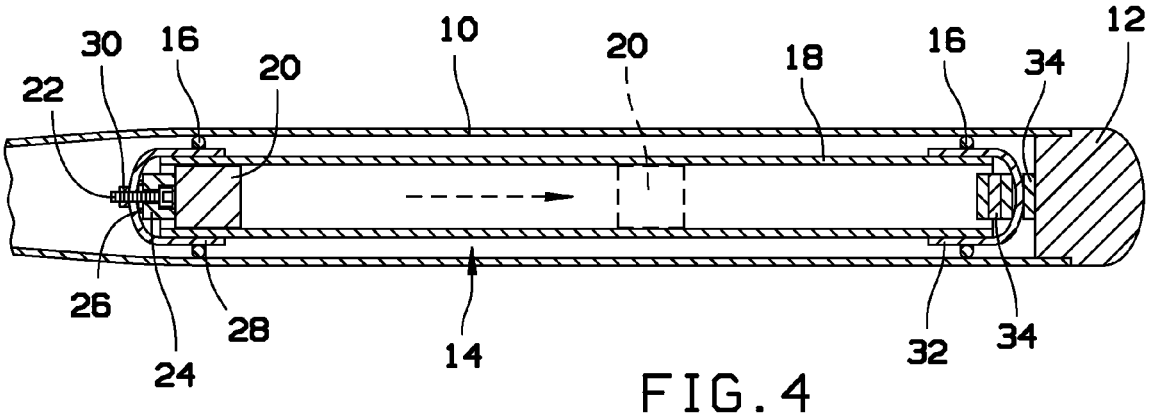
FIG. 4 is a cross-sectional view taken along line 4-4 of FIG. 1.

The pipe 18 can be disposed in a hollow portion of the shell 10 of the bat. The pipe 18 can be supported with one or more stabilizing outer o-rings 16, as shown in FIG. 2. With wooden bats, the pipe 18 can be disposed in a hollowed-out portion of the bat, for example.

The magnet 24 can be secured to a proximate end cap 28 by various means, such as with a bolt 22 that passes through a hole in the magnet 24, through another hole in the end cap 28 and is secured by a lock nut 30. An o-ring-26 can be disposed between the magnet 24 and the proximate end cap 28. A distal end cap 32 and have one or more shock pads 34 disposed inside thereof to absorb the impact of the weight 20 thereupon when the bat is used. An additional shock pad can be disposed external to the distal end cap 32, between the distal end cap 32 and the shell end cap 12. The weight 20 can freely slide inside the pipe 18, without the need of a weight guide, for example.

One benefit of the warm up and training bat of the present invention is the batter's ability to experience muscle memory just prior to reaching the field's batter's box where live pitching is present. The impact of the sliding weight 20 can provide muscle memory and can result in proper training of a batter's swing to produce the ball direction desired. The warm-up and training bat can also be used in hitting a ball off a batter's tee in a stationary position, resulting in batting practice and exercise. The combination of all of these hitting arrangements will insure the proper training and warm-up experience for the batter, resulting in a finer tuned swing.

The shell 10 could be purchased from an aluminum bat manufacturer with threads located at the end of the bat barrel for threading the end cap 12. All the other components, with the exception of the sliding weight length, the PVC tube length, and the end cap 12 are standard components that could be purchased. Assembly of all items of the sliding weight mechanism 14 can be accomplished easily and inserted into the barrel end of shell 10. The end cap 12 can be threaded into the barrel end of the shell 10, securing the sliding weight mechanism 14 inside. Also, the mechanism 14 could be assembled and placed into a relative position for a wound bat to encompass. Alternatively, the mechanism 14 could be assembled and inserted into a wooden bat (hollow barrel) and capped to contain the mechanism.

There are a number of warm up devices utilized in helping a baseball or softball player in getting ready for swinging a bat just prior to going to the plate to hit a baseball or softball. Those conventional devices exercise a batter's muscles in hopes to increase the batter's bat speed. The warm up and training bat of the present invention is designed to do more than an exercise device to will increase bat speed at the plate. The device of the present invention can be used in multiple areas such as warm-up (exercise) bat and a training bat.

It should be understood, of course, that the foregoing relates to exemplary embodiments of the invention and that modifications may be made without departing from the spirit and scope of the invention as set forth in the following claims.

What is claimed is:

1. A bat comprising:

a shell;

a pipe fitting inside the shell;

a proximate end cap disposed proximate a handle end of the bat and a distal end cap disposed proximate a barrel end of the bat, the proximate end cap and the distal end cap disposed on ends of the pipe;

a bat end cap covering the inside of the shell;

a shock pad disposed on an exterior end of the distal end cap between the distal end cap and the bat end cap; and a weight disposed inside the pipe, the weight operable to slide from a first end of the pipe, adjacent the proximate end cap, to a second end of the pipe, adjacent the distal end cap.

2. The bat of claim 1, further comprising a magnet disposed on the first end of the pipe, the magnet attracting and releasably holding the weight.

3. The bat of claim 2, wherein the magnet is attached to an inside of the proximate end cap.

4. The bat of claim 1, further comprising stabilizing outer o-rings disposed about an outer periphery of the proximate end cap and the distal end cap.

5. The bat of claim 1, further comprising one or more shock pads disposed inside the distal end cap, the one or more shock pads operable to absorb shock of the weight when the weight moves to the second end of the pipe.

6. A warm up and training bat comprising:

a shell;

a pipe fitting inside the shell;

a proximate end cap disposed proximate a handle end of the bat and a distal end cap disposed proximate a barrel end of the bat, the proximate end cap and the distal end cap disposed on ends of the pipe;

a weight disposed inside the pipe, the weight operable to slide from a first end of the pipe, adjacent the proximate end cap, to a second end of the pipe, adjacent the distal end cap;

a shock pad disposed on an exterior end of the distal end cap between the distal end cap and the bat end cap;

one or more shock pads disposed inside the distal end cap, the one or more shock pads operable to absorb shock of the weight when the weight moves to the second end of the pipe; and a magnet disposed on the first end of the pipe, the magnet attracting and releasably holding the weight, wherein the magnet is attached to an inside of the proximate end cap.

7. The warm up and training bat of claim 6, further comprising stabilizing outer o-rings disposed about an outer periphery of the proximate end cap and the distal end cap.

8. The warm up and training bat of claim 6, further comprising a bat end cap covering the inside of the shell.

* * * * *